US007097433B2

(12) United States Patent
Struthers et al.

(10) Patent No.: US 7,097,433 B2
(45) Date of Patent: Aug. 29, 2006

(54) FUEL TRANSFER PUMP

(76) Inventors: Kevin D. Struthers, 109 Bradborne Cir., Clayton, NC (US) 27520; Michael C. Webb, 10701 Golf Link Dr., Raleigh, NC (US) 27617

( * ) Notice: Subject to any disclaimer, the term of this patent is extended or adjusted under 35 U.S.C. 154(b) by 96 days.

(21) Appl. No.: 10/260,760

(22) Filed: Sep. 30, 2002

(65) Prior Publication Data

US 2003/0210991 A1 Nov. 13, 2003

Related U.S. Application Data

(60) Provisional application No. 60/325,504, filed on Sep. 28, 2001.

(51) Int. Cl.
*F04B 17/03* (2006.01)

(52) U.S. Cl. ..... 417/371; 417/424.1

(58) Field of Classification Search ..... 417/84, 417/89, 366, 371, 424.1, 423.11
See application file for complete search history.

(56) References Cited

U.S. PATENT DOCUMENTS

| | | | | |
|---|---|---|---|---|
| 2,261,915 | A | 11/1941 | Korte et al. | 103/87 |
| 2,406,947 | A * | 9/1946 | Harlamoff | 417/423.11 |
| 2,667,842 | A * | 2/1954 | Shallenberg | 417/424.1 |
| 2,821,993 | A * | 2/1958 | Pacey et al. | 417/424.1 |
| 3,135,220 | A * | 6/1964 | Haynes | 417/424.1 |
| 3,992,133 | A | 11/1976 | Brunner | 417/366 |
| 5,050,567 | A | 9/1991 | Suzuki | |
| 5,135,364 | A * | 8/1992 | McEwen | 417/424.1 |
| 5,427,074 | A | 6/1995 | Tuckey | 123/514 |
| 5,454,697 | A | 10/1995 | Nakanishi | 417/423.3 |
| 5,613,844 | A | 3/1997 | Tuckey et al. | 417/366 |
| 6,213,726 | B1 | 4/2001 | Tuckey | 417/199.1 |

FOREIGN PATENT DOCUMENTS

WO PCT/US02/31028 2/2002

* cited by examiner

*Primary Examiner*—Michael Koczo, Jr.
(74) *Attorney, Agent, or Firm*—Drinker Biddle & Reath LLP; Joseph R. DelMaster, Jr.

(57) ABSTRACT

The fuel transfer pump is a combination suction and pressure pump in a manifold above the fuel storage tank. The fuel transfer pump is contained within a manifold. The pump is liquid cooled (more specifically, fuel cooled) and is located in a manifold above the fuel storage tank and not submerged inside the tank. The fuel transfer pump draws (using suction) the fuel up from the bottom of the tank though the pipe column into the manifold and then under pressure pumps it to one or more fueling dispensers.

15 Claims, 7 Drawing Sheets

FUEL TRANSFER PUMP

RELATED APPLICATIONS

This application claims priority to U.S. Provisional Application Ser. No. 60/325,504 filed on Sep. 28, 2001.

FIELD OF THE INVENTION

This invention relates to the field of combustible fluid pumping systems, particularly those involving an underground storage tank and an aboveground combustible liquid dispenser.

BACKGROUND OF THE INVENTION

There are two principal types of fuel pumping systems. One is a suction type fuel delivery system and the other is a pressure type fuel delivery system.

Suction type fuel pumps are the most common type of fuel delivery pump used outside of the United States. A suction pump is typically a positive displacement type pump housed inside the fueling dispenser. The fuel is drawn or sucked under negative pressure from the fuel storage tank through an underground piping system to a single fuel dispenser. For safety reasons, the fuel dispenser is often a substantial distance from the storage tank.

The advantage of a suction pumping system is that in the event of a breach in the fuel delivery line, all of the fuel in the line will drain back into the tank, and no fuel is pumped into the ground under pressure. There are several disadvantages of a suction piping system:

(1) It typically requires one pump per hose, or many pumps per fueling facility (typical is 12 suction pumps per fueling facility). Each pump requires its own piping run, which results in excessive piping and greater risk of an environmentally dangerous fuel leak through the additional pipe runs.

(2) Pumps are located inside the dispenser. This is an inconvenient and dangerous area to perform routine service work. Customers frequent the dispenser area and could be in danger or at unnecessary risk when the pumps are being serviced.

(3) Suction pumps commonly experience fuel vapor lock and can lose prime especially in warm temperatures or at high altitudes. When a pump loses prime, highly flammable fuel vapors are compressed and pumped through the system, increasing the chance of a dangerous explosion.

(4) Suction pump systems typically have lower flow rates than pressure type pumping systems and are not desirable for use at large fueling facilities with many fueling points.

Pressure pumping systems are more commonly used in the United States and Mexico. A pressure pump is commonly referred to as a submersible pump. The pump and electric motor are located inside the bottom of the fuel tank submerged in the fuel itself. The submersible pump is designed to pump fuel from the bottom of the fuel storage tank to one or more dispensers though an underground fuel delivery piping system. The advantages of submersible pressure type pump are as follows:

(1) Only one pressure pump is required per fuel grade (typical is 3 pumps per fueling facility).

(2) Pressure pumps require less underground delivery piping because the underground piping may be routed in series or a branching layout. Less underground piping saves money and reduces the risk of piping leaks.

(3) Pressure pumps are located at the tanks away and from the fueling customers. This is a more convenient and less dangerous area to perform routine service work.

(4) Pressure pumps located at the low end of the piping system cannot loose prime and are not affected by heat or high altitude.

(5) Pressure pumps systems typically pump a higher volume of fuel than a suction pump (they are more suitable larger high volume fueling facilities).

The disadvantages of a of submersible type pressure pumps are as follows:

(1) Although a submersible pump can pump a higher volume of fuel than that of a fuel suction pump it can only supply about 6 nozzles at one time or a maximum of 65 gallons per minute. Many large fueling facilities exceed the capabilities of submersible pumps when several nozzles are activated simultaneously.

(2) A submersible pump's electric motor is dangerously submerged in the fuel located inside the fuel storage tank. Electric power inside the tank increases the potential of an explosion especially when the tank is low (due to increased fuel vapors).

(3) Locating the pump/motor inside the tank means that a long pump column is required to be installed at the factory and not in the field. The result is that the submersible pump is awkward to handle and ship (can be up to 15 feet long), more costly to ship, and thus more likely to incur shipping damage during transit and while handling.

(4) The fuel flow path through a submersible pump is restrictive and creates considerable friction loss. The electric motor is directly in the flow path with only a tiny gap around the outside of the motor for the fuel to pass by.

(5) A submersible pump/motor is inserted into the tank typically through a 4" tank fitting. Therefore the outside diameter of the pump/motor must be smaller than the inside diameter of the tank fitting. This requires submersible pumps to use high aspect ratio electric motors (long and thin motors) which are inefficient. In addition these submersible pumps have small diameter impellers (less than 3.5" in diameter) that are not designed for high flow output.

(6) A submersible pump motor has a "dry stator". This means that the motor's stator is contained within a sealed stainless steel metal casing. Stainless steel is a non-magnetic metal which becomes a restrictive barrier between the stator and rotor which operates on electrically generated magnetic power. The stainless steel casing reduces the efficiency of the submersible pump motor because it retains heat and interferes with the magnetic motor.

SUMMARY OF THE INVENTION

The current invention overcomes both of the prior art pumps' shortcomings by mounting a combination suction and pressure pump in a manifold above the fuel storage tank. The inventive pump will be referred to as a fuel transfer pump herein, and although reference is made to pumping fuel and gasoline, the invention could be used with pumping any combustible liquid from a storage tank.

The fuel transfer pump and motor are contained within a manifold. The motor is liquid cooled (more specifically, fuel cooled) and is located in a manifold above the fuel storage tank and not submerged inside the tank. The fuel transfer pump draws (using suction) the fuel up from the bottom of the tank though the pipe riser into the manifold and then, under pressure pumps it to one or more fueling dispensers.

This new fuel transfer pump invention offer many new features and advantages over conventional suction and submersible type fuel delivery pumps:

(1) Typically only one fuel transfer pump is required per fuel grade (typical is 3 pumps per fueling facility).

(2) Fuel transfer pumps require less underground delivery piping than suction pumps because the underground piping may be routed in series or a branching layout. Less underground piping saves money and reduces the environmental risk of piping leaks.

(3) Fuel transfer pumps are located at the tanks away from the fueling customers which is more convenient and less dangerous area to perform routine service work.

(4) Fuel transfer pumps located at the low end of the piping system are not likely to lose prime and are not affected by heat or high altitude. The fuel transfer pump has one or more check valves to prevent a loss of prime in the column.

(5) Fuel transfer pumps are more energy efficient and capable of pumping a much higher volume of fuel than both suction pumps and submersible pumps making them more suitable foe use in large service stations with many fueling points. The reasons are as follows:

(1) The electric motor used in the fuel transfer pump has a "wet stator" which makes it more efficient to cool and having no stainless steel casing to interfere with its cooling or magnetic operation. The better you can cool a electric motor the more efficient it is, the more power can be drawn and the longer you can extend it's operational life.

(2) Because the pump/motor does not have to be inserted though a small 4" tank bung the electric motor and pump impeller can be a much larger diameter. Larger diameter electric motors are considerably more efficient than tall and thin electric motors found on submersible pumps. Larger diameter centrifugal pump impellers (5½" diameter) can also pump considerably more fuel (higher flow rate) than small diameter impellers.

(3) The fuel transfer pump's pump/motor is located in the manifold with a considerably larger fuel flow path around the pump/motor (more than ⅝ of an inch) compared to a submersible pump which only has a very small gap (less than an 1/16 of an inch).

(4) The fuel transfer pumps manifold is designed not to have any physical restrictions greater than the area of the discharge port (2" diameter) of the pump.

(5) Because the pump/motor is located in the manifold and not inside the tank, the 4" "riser pipe" (connects the pump to the 4" tank bung) and the 2" "pipe column" can be supplied by the installing contractor and cut-to-length and threaded at the job site. The advantage is that the fuel transfer pump ships in one small square box (16" W×16"H×16" L) and not as a long piece of equipment like a submersible pump (typically 6 feet to 12 feet long). This also means one fuel transfer pump model can fit any diameter tank which is not the case with submersible pumps.

(6) Because the fuel transfer pump has considerably more flow than a comparable suction pump or submersible pump one fuel transfer pump model can accommodate as few a one dispenser to as many as 10 dispensers (small and large service stations). This also means less inventory (saves money) for the stocking distributor or contractor.

(7) The fuel transfer pump is designed so that the pump impeller is always submerged in a reservoir of fuel sufficient to allow the sump to reinstate prime in the column in the event there is a loss of prime in the column. Any loss of prime in the pipe column will not affect the amount of fuel in this reservoir.

DETAILED DESCRIPTION

Figure 1:
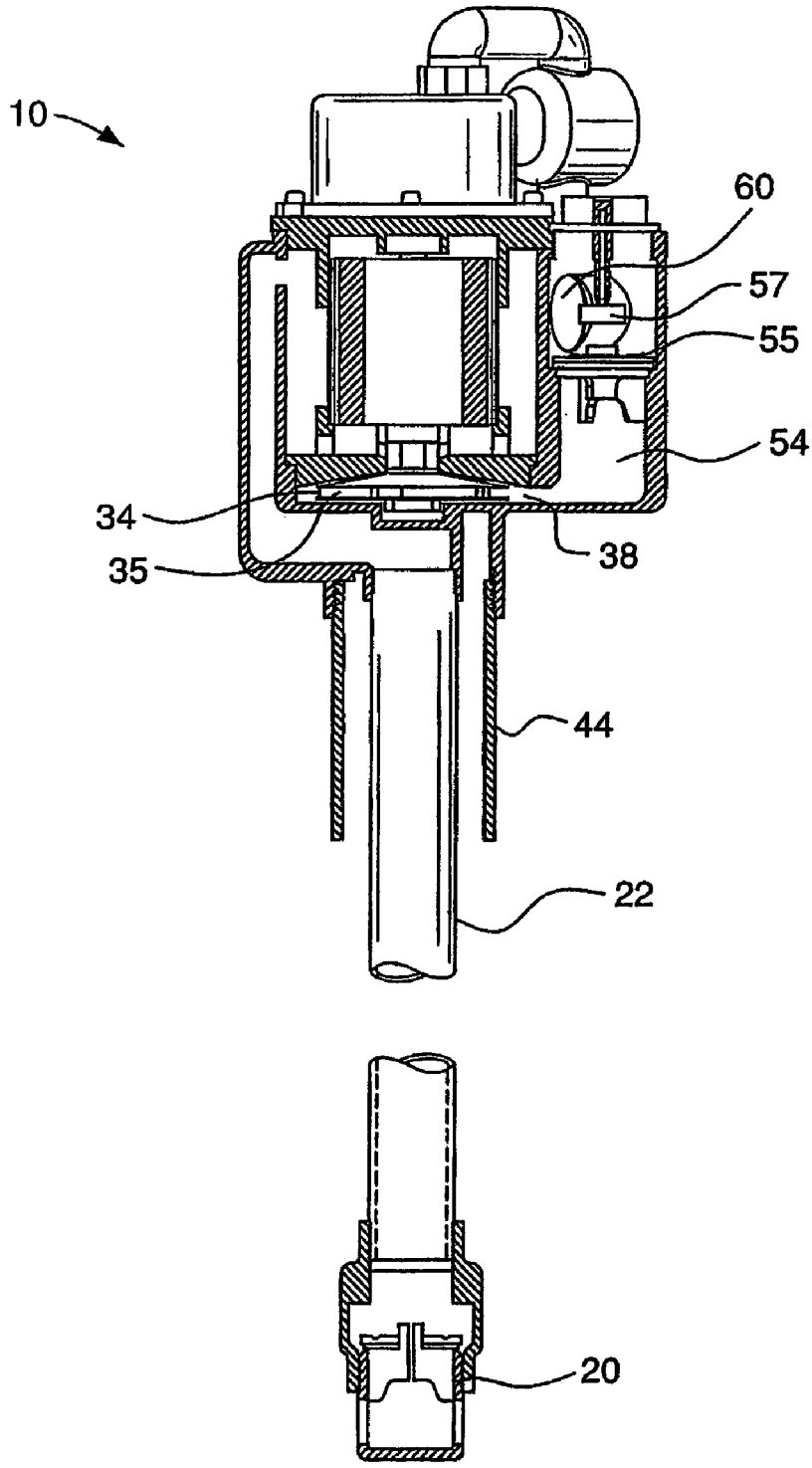
FIG. 1 is an elevation cross section of the fuel transfer pump of the invention.
Figure 2:
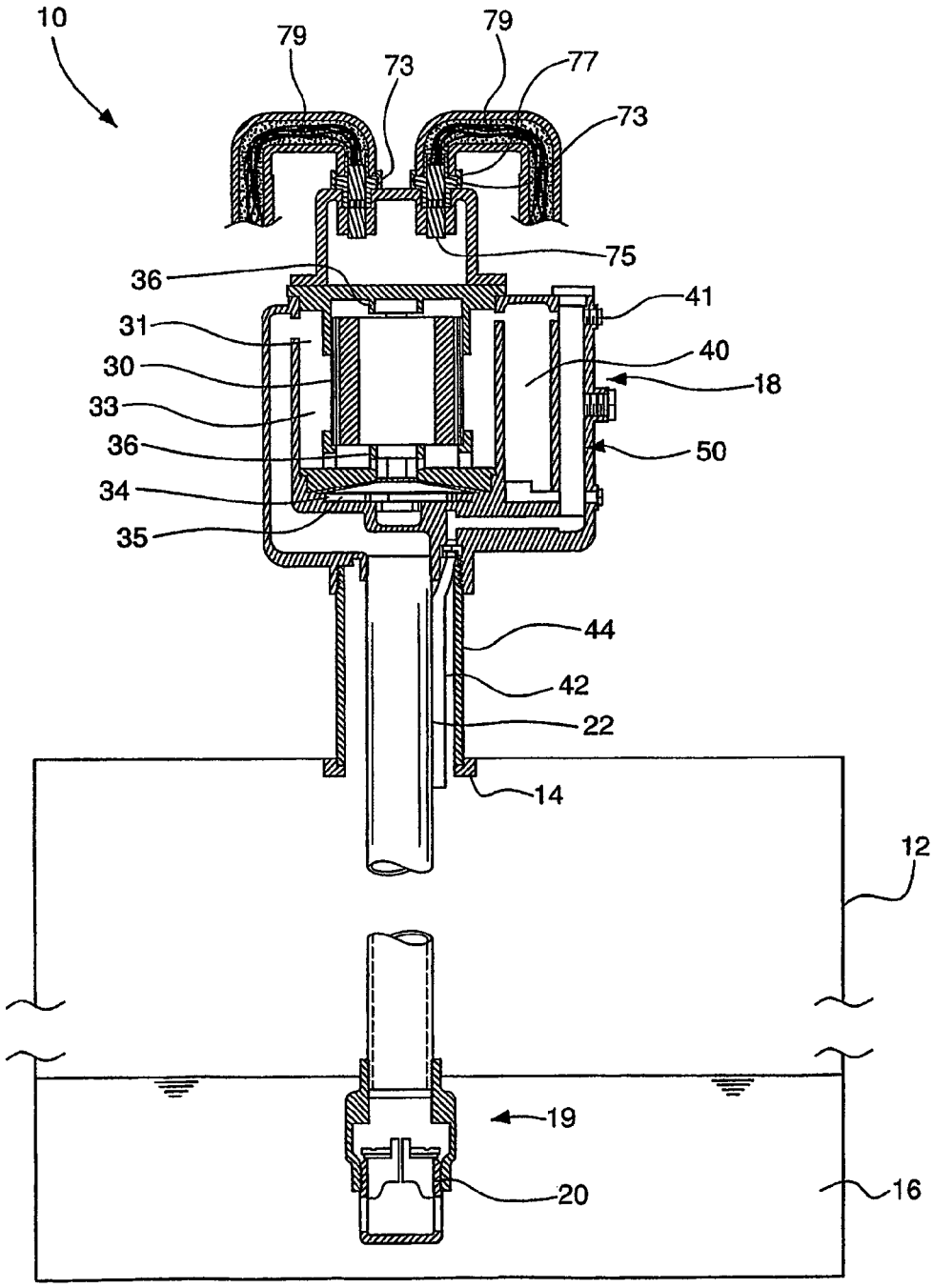
FIG. 2 is a side elevation cross section of the pump assembly of the invention.
Figure 3:
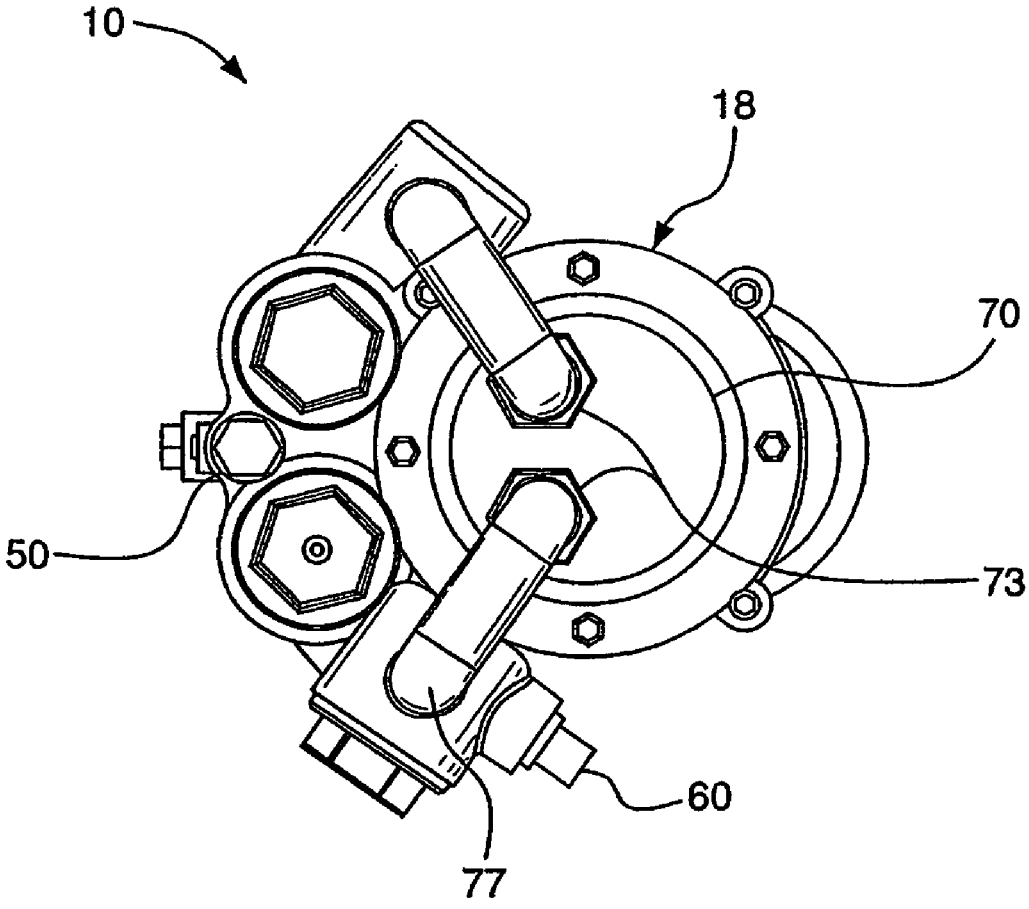
FIG. 3 is a top view of the fuel transfer pump.
Figure 4:
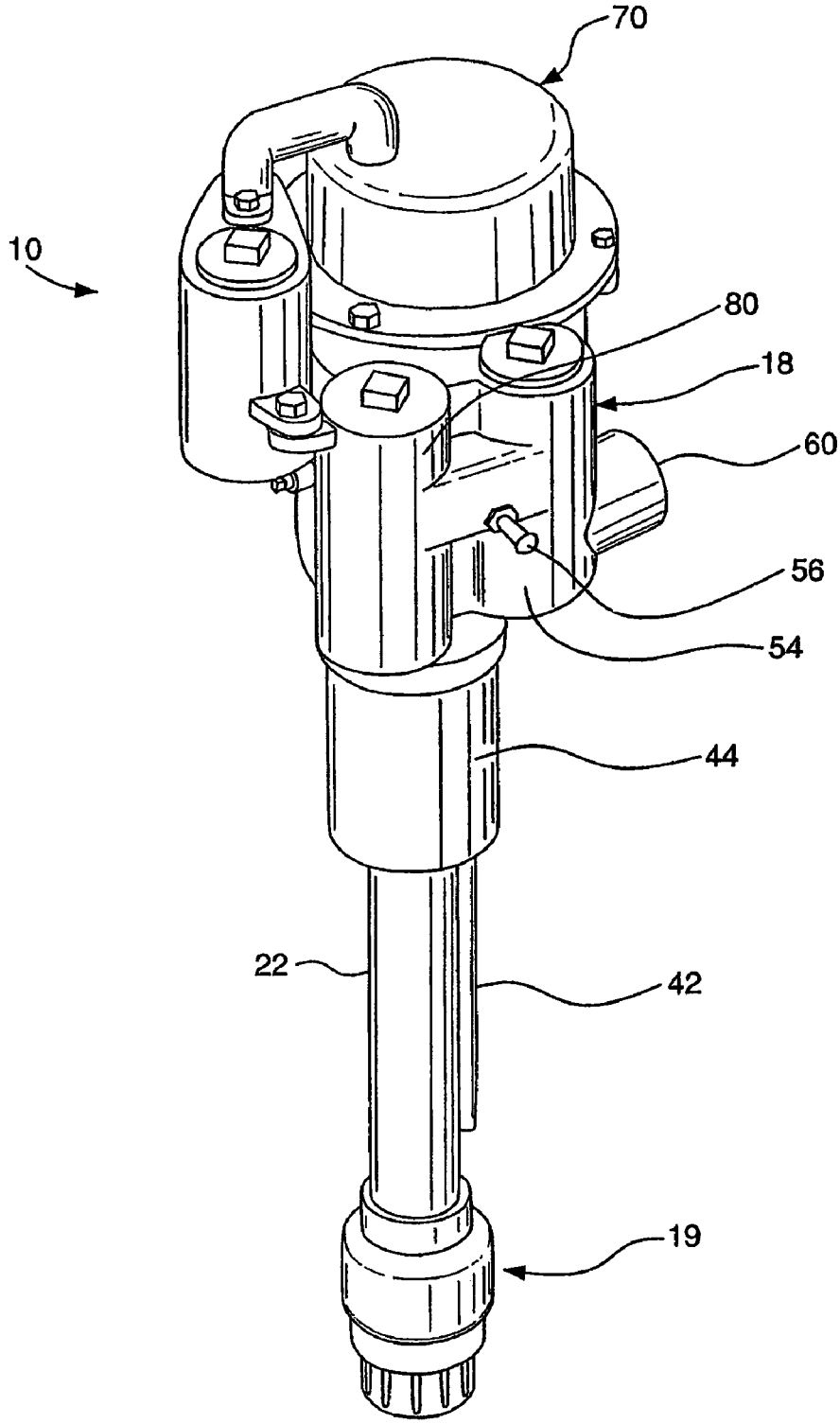
FIG. 4 is a perspective view of the fuel transfer pump.
Figure 5:
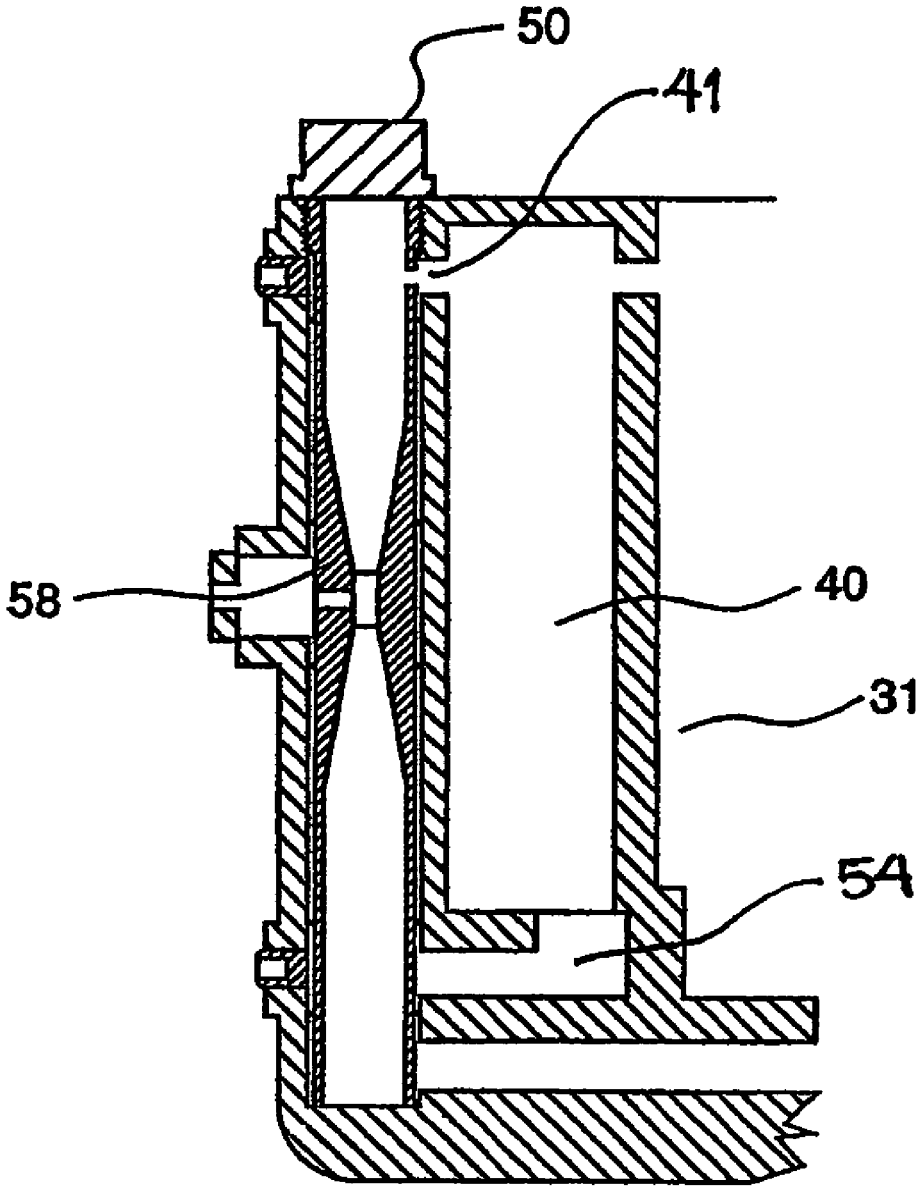
FIG. 5 is a partial cross section through the fuel transfer pump.
Figure 6:
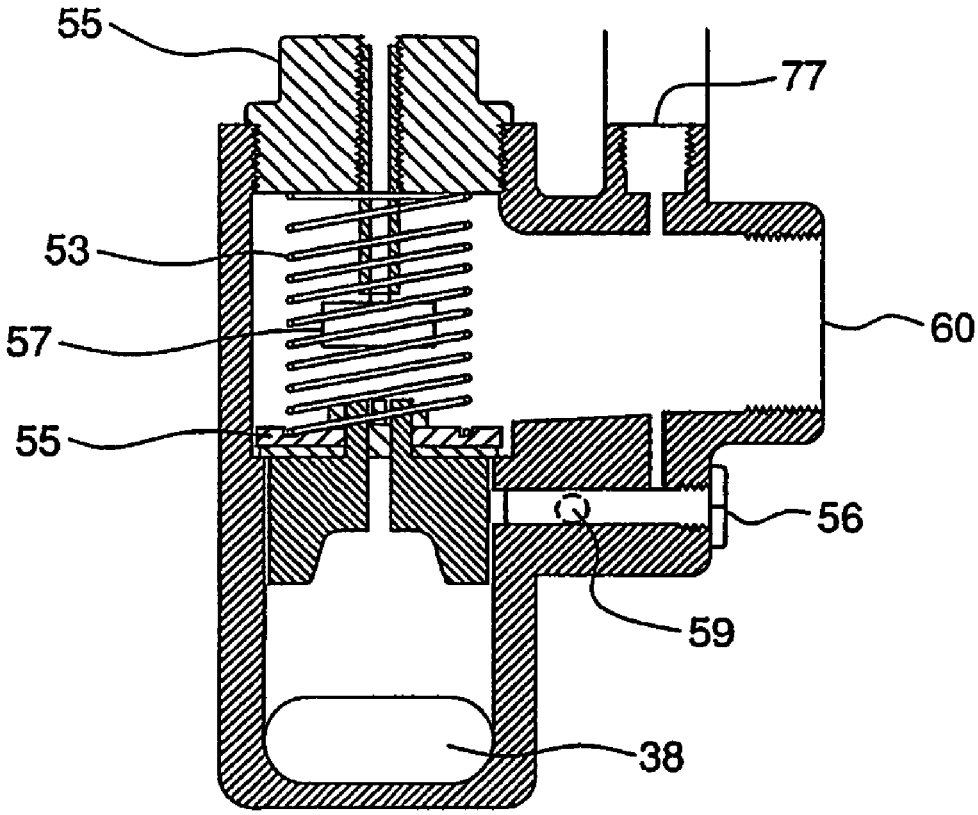
FIG. 6 is a second partial cross section through the fuel transfer pump.

FIGS. 1 and 2 show a cross section through the fuel transfer pump 10 and storage container 12. FIG. 3 shows a top view of the fuel transfer pump. FIG. 4 shoes a perspective view of the fuel transfer pump, and FIGS. 5 and 6 show partial cross sections through the fuel transfer pump.

The fuel transfer pump 10 has a stand pipe 44, that is commonly a 4" diameter pipe. The stand pipe 44 is connected to the bung 14 of the storage container in a leak resistant fit, and the stand pipe 44 supports the weight of the fuel transfer pump 10. A narrower diameter riser pipe/column 22 and a return pipe 42 are contained within the stand pipe 44 and extend into the tank 12. The end of the riser pipe/column 22 has an intake 19 ideally submerged within the combustible liquid or fuel 16 in the storage container 12. A foot valve 20 at the end of the riser pipe serves as a kind of check valve. The foot valve 20 prevents pipe flow in the direction of the tank 12, and thus insures that the fuel transfer pump 10 is always primed.

A sealed manifold 18 protects the fuel transfer pump's component parts and chambers from corrosion and damage. An electric motor 30 within the pump motor chamber 31 is attached to and operates the pump 34, which is commonly an impeller pump. The pump impeller 34 works by taking in fuel 16 through its eye (the hole through the top of the impeller, not shown) and "flinging" the fuel outward through its blades 35 using centrifugal force.

An air bell chamber 40 collects excess fuel and vapor releasing them through an air bell chamber outlet port 41. A syphon assembly 50 directs any vapor and air from the air bell chamber outlet port 41 back to the storage container 12 through the fuel transfer pump return pipe 42.

The fuel transfer pump 10 may include a second check valve assembly 55 contained within the check valve chamber 54, located between the air bell chamber 40 and the pump outlet 60. The fuel transfer pump 10 may also include a leak detection chamber 80 which may or may not have a line leak detector connected (connection 77 is shown). This chamber nominally has a 2" NPT access port 77 for mounting of a 2" line leak detector. Once the fuel has passed though the line leak detection chamber 80 it travels downward and out of the pump 10 though the 2" NPT threaded pump outlet port 60. Note: the fuel transfer pump shown in FIG. 4 does not show the connected leak detector.

The fluid transfer pump 10 may also include a manual relief valve 56 (FIG. 6) to manually dissipate line pressure during line servicing. This pull type valve is located in the wall between the check valve chamber 54 and the leak detection chamber 80. Once the manual relief valve 56 is pulled liquid pressure built up inside the leak detection chamber 80 will evacuate though the manual relief valve port 59 which connects to the check valve chamber 54 under the line check valve 55. The fluid pressure is then transferred out through the air bell chamber outlet port 41 located at the upper end of the air bell chamber and directed back into the underground storage container 12 through the syphon assembly 50 and return pipe 42.

The electrical junction box 70 is an independent casting from the main manifold casting 18 and is secured to the manifold by a single bolt fastener. This single bolt connection allows the junction box to swivel from side to side for alignment of the bayonet type yoke assemblies 73 and to permit removal of the box 70 without disconnection of the electrical conduit. The junction box has small NPT ports 75 located on the underside of the box for a sealed connection of the electrical conduit. Through this conduit, the power wires 79 enter the junction box and connect to either the electric motor's start-up capacitor (for the wires shown on the left of FIG. 2) or the leak detection port (for the wires shown on the right). These wire connections are made though a 2" threaded access ports 75 located on the upper side of the junction box 70. The fully adjustable yoke assemblies 73 can swing from side-to-side and move up and down to provide a liquid tight and explosion proof electric plug-in connection into the motor controller housing and leak detection port 82.

Operation

When the electric pump motor 30 is turned on, fuel is drawn from the tank 12 through the fuel transfer pump 10 and out through the pump assembly outlet 60 to the dispensers (not shown). The foot valve 20 is installed in the lower end of the riser pipe 22 to help maintain prime inside the pipe during low fuel levels inside the tank 12. A back-up check valve 55 inside the manifold 18 also helps insure prime in the fuel transfer pump should the foot valve fail.

The fuel inside the riser pipe 22 then enters the upper end of the pump/motor chamber 31 that contains the pump 34 and motor 30. In order to cool the pump/motor assembly, a gap 33 of approximately ¾ inch is provided between the assembly and the pump/motor chamber inner wall through which the cool fuel passes. The fuel flows downward into the eye of the centrifugal type pump impeller 34. This impeller has been designed so that the fuel enters the eye of the pump impeller 34 from the top and not the bottom. The combination of a continuously flooded pump/motor chamber and a pump impeller with a top inlet permits the pump to reinstate prime in the event of a drop in the level of fuel in the pipe column. The motor is spun on bearings 36 located above and below the motor.

Once the fuel has entered the rotating pump 34 it is flung though centrifugal force out to the outside wall of the volute section of the pump/motor chamber 31. Here the fuel exits the pump/motor chamber 31 and into the check valve chamber 54 through outlet pump chamber outlet 38. Any air or excess fuel in the pump/motor chamber 31 will rise and travel to the air bell chamber 40. The air or excess fuel is then evacuated though a small air bell chamber outlet port 41 connected to an opening on the syphon assembly 50 that allows a small volume of fuel and/or air to continuously return to the storage container 12 via the return pipe 42 during pumping operation. This small flow of fuel is primarily used to generate a vacuum in a jet type venturi 58 built into the syphon assembly (see FIG. 5). Note: The capability of generating a vacuum is common feature on fuel delivery pumps to assist in maintaining vacuum when siphoning from one underground storage tank to another.

Most of the fuel 16 does not pass through the air bell chamber outlet port 41; it passes under the air bell chamber 40 through the outlet from motor cavity 38 and it then enters the check valve chamber 54 where it forces the spring 53 loaded line check valve 55 to open for the fuel to escape into the leak detection chamber 80. The line check valve 55 is designed to prevent the fuel contained in the piping line and dispenser from flowing back into the underground storage container due to head pressure. It also allows for continuous line leak testing by creating a positive seal. Note: The line check valve 55 has a manual test plug 57 that can lock down the line check valve 55 to perform both tank and pipe line integrity pressure testing.

The center of the line check valve is fitted with a small line relief valve for dissipating excessive line pressure due to thermal expansion in the pipe line. Once the line relief valve has been activated the fluid pressure is then transferred out through the return outlet port 41 located at the upper end of the air bell chamber 40 and directed back into the underground storage tank 12 through the return/syphon assembly 50.

After the fuel has passed though the line check valve it then enters the leak detection chamber 80 which may or may not have a line leak detector installed. This chamber has a 2"NPT access port 82 for mounting of a 2" line leak detector. Once the fuel has passed though the line leak detection chamber 80, it travels out though the 2" NPT threaded pump outlet port 60.

Figure 7:
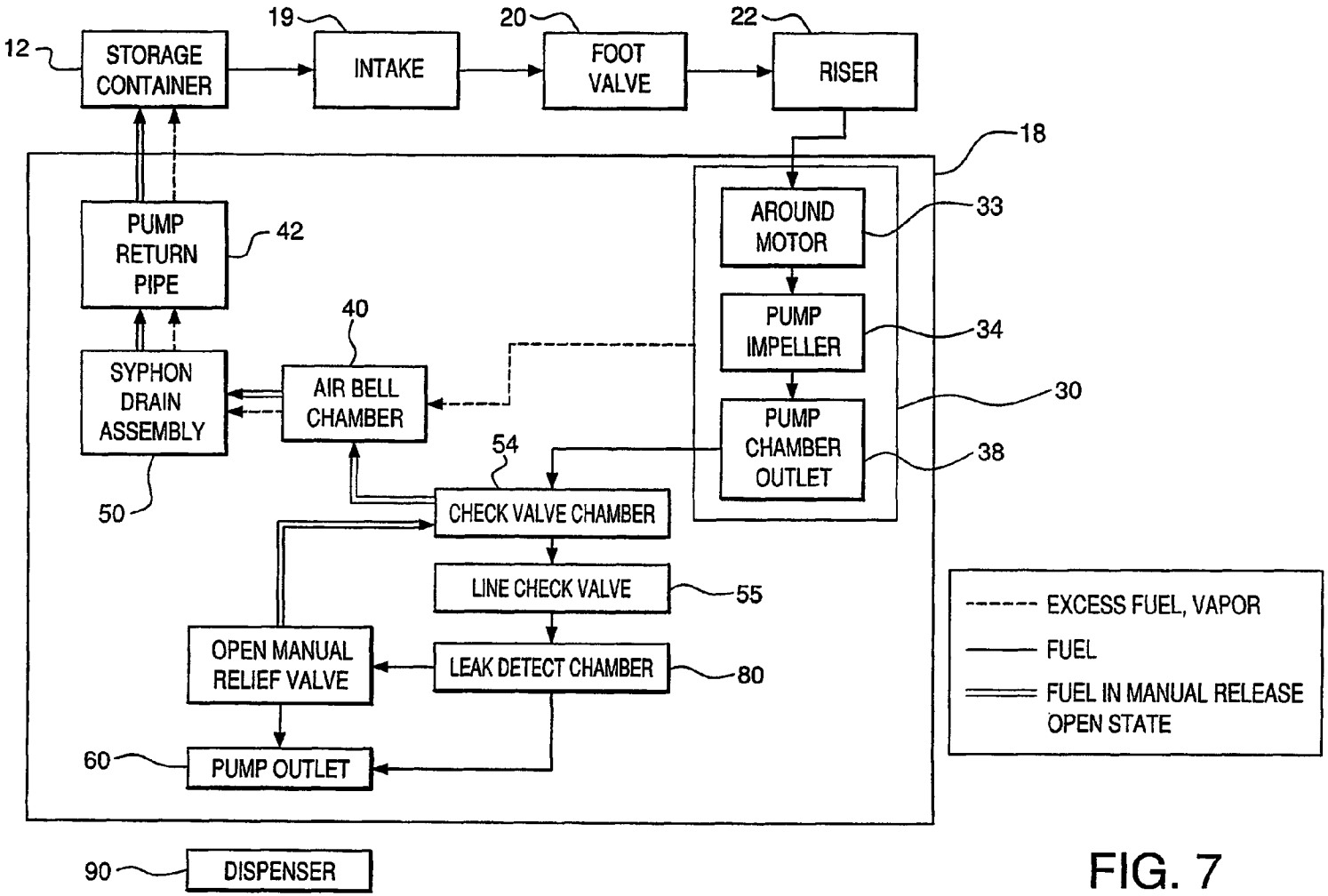
FIG. 7 is a flow chart showing the path of a combustible liquid from a storage container through the pump assembly to a dispenser.

FIG. 7 shows the path of the fuel from the storage tank 12 through the fuel transfer pump 10 to the dispenser 90. The flow of the fuel is discussed above, except to mention that from the outlet port 60, the fuel is pumped to the dispenser 90. narrow diameter riser pipe/column

We claim:

1. A pumping assembly for removing a combustible liquid contained within a storage container comprising:

a) a fluid transfer pump comprising:

an intake having an opening;

a pump/motor chamber having a fluid-cooled motor and a pump contained therein, the pump/motor chamber having an inlet, and an outlet to an air bell chamber;

the air bell chamber having an air bell chamber outlet port;

an electrical junction box to connect power wires to the motor;

a pump chamber outlet connected to the air bell chamber;

a foot valve connected to a riser pipe positioned between the intake and the pump/motor chamber that only permits fluid flow in the direction of the pump/motor chamber;

wherein the pump/motor chamber is connected to the air bell chamber permitting the fuel to flow from the pump/motor chamber to the air bell chamber;

wherein the air bell chamber outlet port is connected to the pump chamber outlet permitting the fuel to flow to the air bell chamber; and wherein the air bell chamber outlet port is connected to the storage container permitting the fluid to flow from the air bell chamber outlet port to the storage container;

b) the storage container including a bung;

wherein the fluid transfer pump is connected to the bung of the storage container to form a leak resistant fit and removably joined to the storage container to permit the riser pipe to pass through;

c) a fluid contained within the storage container;

wherein electricity flows from the power wires to activate the motor passing through the electrical junction box;

wherein the motor activates the pump;

wherein the pump activation draws the fluid i) from the storage container;

ii) then through the foot valve;

iii) then through the riser pipe;

iv) then into the pump/motor chamber; and v) then into the air bell chamber;

wherein the fluid may flow i) through the pump whereupon the liquid is pushed out the air bell chamber outlet port; or ii) through the path between the air bell chamber outlet port and the storage container.

2. The pumping assembly of claim 1 further comprising a check valve chamber located in between the air bell chamber and the pump chamber outlet wherein the check valve chamber restricts fluid flow through the check valve chamber in the direction of the pump outlet.

3. The pumping assembly of claim 2 further comprising a leak detection assembly comprising:

a) a leak detection chamber located in between the check valve chamber and the pump outlet; and b) a leak detection access port that is electrically connected to the electrical junction box, wherein the leak detection assembly detects a leak within the pumping assembly.

4. The pumping assembly of claim 3 further comprising:

a) a manual relief valve port that has an open state and a closed state, in the manual relief valve open state, fluid passes from the leak detection chamber i) into the check valve chamber;

ii) then into the air bell chamber;

iii) then through the air bell chamber outlet port; and iv) then into the storage container;

in the manual relief valve closed state, fluid passes from the check valve chamber into the leak detection chamber.

5. The pumping assembly of claim 1 wherein the pump is an impeller pump.

6. The pumping assembly of claim 2 wherein the pump is an impeller pump, the impeller pump has a circular cross-section, permitting fluid to pass through and travel between the intake and the check valve chamber.

7. The pumping assembly of claim 1 further comprising a syphon assembly located between the air bell chamber outlet port and the storage container.

8. The pumping assembly of claim 7 wherein the syphon assembly forms a jet type venturi within a path through the syphon assembly.

9. The pumping assembly of claim 1 further comprising:

a) a dispenser for dispensing the fluid; and b) a path between the pump outlet and the dispenser.

10. The pumping assembly of claim 9 wherein the storage container is underground and the dispenser is above ground.

11. The pumping assembly of claim 6 wherein the pump is self-priming.

12. The pumping assembly of claim 1 wherein pressure that builds up in the fuel transfer pump is relieved through a pressure relief valve.

13. The pumping assembly of claim 1 further comprising a pressure relief valve that equalizes the pressure within the fuel transfer pump with the pressure outside the pump.

14. The pumping assembly of claim 1 wherein the fluid is combustible.

15. The pumping assembly of claim 1 wherein the fluid is fuel.

* * * * *